United States Patent [19]

Drummond

[11] 4,158,557

[45] Jun. 19, 1979

[54] METHOD AND APPARATUS FOR FORMING FIBER MAT

[75] Inventor: Warren W. Drummond, Allison Park, Pa.

[73] Assignee: PPG Industries, Inc., Pittsburgh, Pa.

[21] Appl. No.: 900,353

[22] Filed: Apr. 26, 1978

[51] Int. Cl.[2] ..... C03B 37/00

[52] U.S. Cl. ..... 65/2; 65/4 R; 65/9; 65/11 R; 156/62.2

[58] Field of Search ..... 65/2, 4 R, 9, 11 R, 65/11 W; 156/62.2

[56] References Cited

U.S. PATENT DOCUMENTS

| | | | |
|---|---|---|---|
| 2,928,121 | 3/1960 | Plumbo | 65/11 R X |
| 3,471,278 | 10/1969 | Griem | 65/11 W X |
| 3,883,333 | 5/1975 | Ackley | 65/2 |

*Primary Examiner*—Robert L. Lindsay, Jr.
*Attorney, Agent, or Firm*—John E. Curley; Alan T. McDonald

[57] ABSTRACT

A method and apparatus for forming a fiber mat is disclosed. The attenuation rate of the attenuator or strand advancing apparatus is varied as the attenuator traverses across the mat formation surface such that a constant rate of attenuation of glass filaments from a bushing is realized. This results in more consistent diameter filaments being formed and thus results in the formation of a more uniform mat. The attenuator may also be employed to lay down mat from previously produced forming packages of strand material from any natural or synthetic fiber.

16 Claims, 6 Drawing Figures

METHOD AND APPARATUS FOR FORMING FIBER MAT

BACKGROUND OF THE INVENTION

Glass fiber mats have utility as reinforcements for resins, both as laminates and as single layers, carpet backing, wall covering, air and water filtration and high temperature insulation.

In U.S. Pat. No. 3,833,333, assigned to the assignee of the present invention and incorporated herein by reference, a method and apparatus is disclosed for forming continuous strand glass fiber mat. In this patent, a plurality of continuous glass strands are attenuated from a plurality of glass fiber forming positions, with the continuous strands being laid across the width of a mat formation surface by traversing strand attenuators across this mat formation surface and above it and projecting the strands onto the surface from the attenuators.

The orientation of the equipment within this system presents limits to its usefulness. First, the attenuators, which must be traversed above the strand formation surface, comprise a driven belt and a motor for driving this belt. Such an apparatus is quite heavy. When traversing this heavy apparatus across the width of the mat formation surface, its traversing speed is limited due to its high inertia and the impact which must be absorbed at each end of its traverse upon reversing its direction. This speed limitation limits the width of mat which can be efficiently produced at a given density for a specific number of fiber forming and attenuating positions. In addition, for a given width of mat, this limits the rate of production of mat at a given density. It is desirable, therefore, to reduce the weight of the attenuator which must be traversed across the width of the mat formation surface to thereby allow increases in the rate of production of mat and/or the width of the mat which can be efficiently produced.

A second problem incurred when employing the method and apparatus of the prior art system is in the consistency of the strand and mat produced. As is well known in the art, for a given bushing orifice diameter, the diameter of the filaments is inversely proportional to the speed of the attenuation, i.e., increases in attenuation speed produces a smaller diameter filament while decreases in the attenuation speed produces increased filament diameter.

In the above-identified patent, the speed of the belts of the attenuator is maintained constant which projects the strands onto the mat formation surface at a constant rate. However, as the attenuator is traversed away from the filament forming bushings, the total attenuation on the filaments is the sum of the speed of projecting the strands onto the mat formation surface and the speed of traversing the attenuator. But, when the attenuator is traversing the mat formation surface in a direction towards the bushing, the total attenuation on the filaments is the difference between the speed of projecting the strands onto the mat formation surface and the speed of traversing of the attenuator. Thus, for example, having an attenuator projecting strands onto mat formation surface at a constant rate of 2,000 feet/minute (605.80 meters/minute) and traversing across the mat formation surface at a rate of 100 feet/minute (30.48 meters/minute), the filaments are attenuated at varying rates of between 1,900 and 2,100 feet/minute (575.32 and 636.28 meters/minute). This results in inconsistent filament diameters and thus inconsistent density mat being produced.

It is, therefore, a major purpose of the present invention to produce a continuous strand glass fiber mat formation system in which the attenuation rate of the filaments is maintained constant to thereby produce more uniform diameter filaments and a more uniform strand and mat.

It is also a major purpose of the present invention to produce an attenuator or strand advancing apparatus which exerts a constant force on the strands and filaments as it traverses over a mat formation surface.

As used herein, the term "attenuator" refers to an apparatus for attenuating and advancing filaments or an apparatus for advancing previously produced forming packages or bobbins of the strands.

THE PRESENT INVENTION

According to the present invention, a method and apparatus for forming a more uniform continuous strand mat, such as a glass fiber mat, is provided. The attenuator, which is traversed across the mat formation surface, may be either a wheel attenuator or a belt attenuator. The attenuator is driven by a belt, chain or the like, which is driven by a remote motor which is not itself traversed across the mat formation surface. This substantially reduces the weight of the traversing attenuator and permits greater speeds of traverse which, in turn, permits a faster mat formation rate at a given width. It also allows for production of greater widths of mat at a given rate of mat length.

In addition, the attenuator is designed such that as it traverses across the mat formation surface, its speed of projecting the strands onto the mat formation surface is varied, due to the constant speed belt or chain driving it. Thus, when the attenuator is traversing away from the bushing or packages of previously formed strand, its strand projection speed is reduced from the set speed of the driving belt or chain in an amount equal to its rate of traverse. When the attenuator is traversing towards the bushing or packages of previous formed strand, its strand projection speed of projection of the strands onto the mat formation surface is increased by its rate of traverse. Thus, the net speed of attenuation or advancement of the filaments and strands remains a constant.

For example, driving the attenuator of the present invention by a constant belt drive of 2,000 feet/minute (605.80 meters/minute), when traversing away from the strand source at 100 feet/minute (30.48 meters/minute), the speed of projection reduces to 1,900 feet/minute (575.32 meters/minute), thus resulting in a net speed of attenuation of 2,000 feet/minute (605.90 meters/minute). When the attenuator is traversing towards the bushing or packages of previously formed strand at a speed of 100 feet/minute (30.48 meters/minute), the attenuator projection increases to 2,100 feet/minute (636.28 meters/minute), thus resulting in a net speed of attenuation of 2,000 feet/minute (605.90 meters/minute). Thus, in either direction of traverse, the filaments and strand are attenuated or advanced at a constant force from the strand source, thus resulting in more consistent diameter filaments and thus resulting in a better quality mat.

BRIEF DESCRIPTION OF THE DRAWINGS

The method and apparatus of the present invention will be more fully described with reference to the drawing figures in which.

DETAILED DESCRIPTION OF THE DRAWINGS

Figure 1:
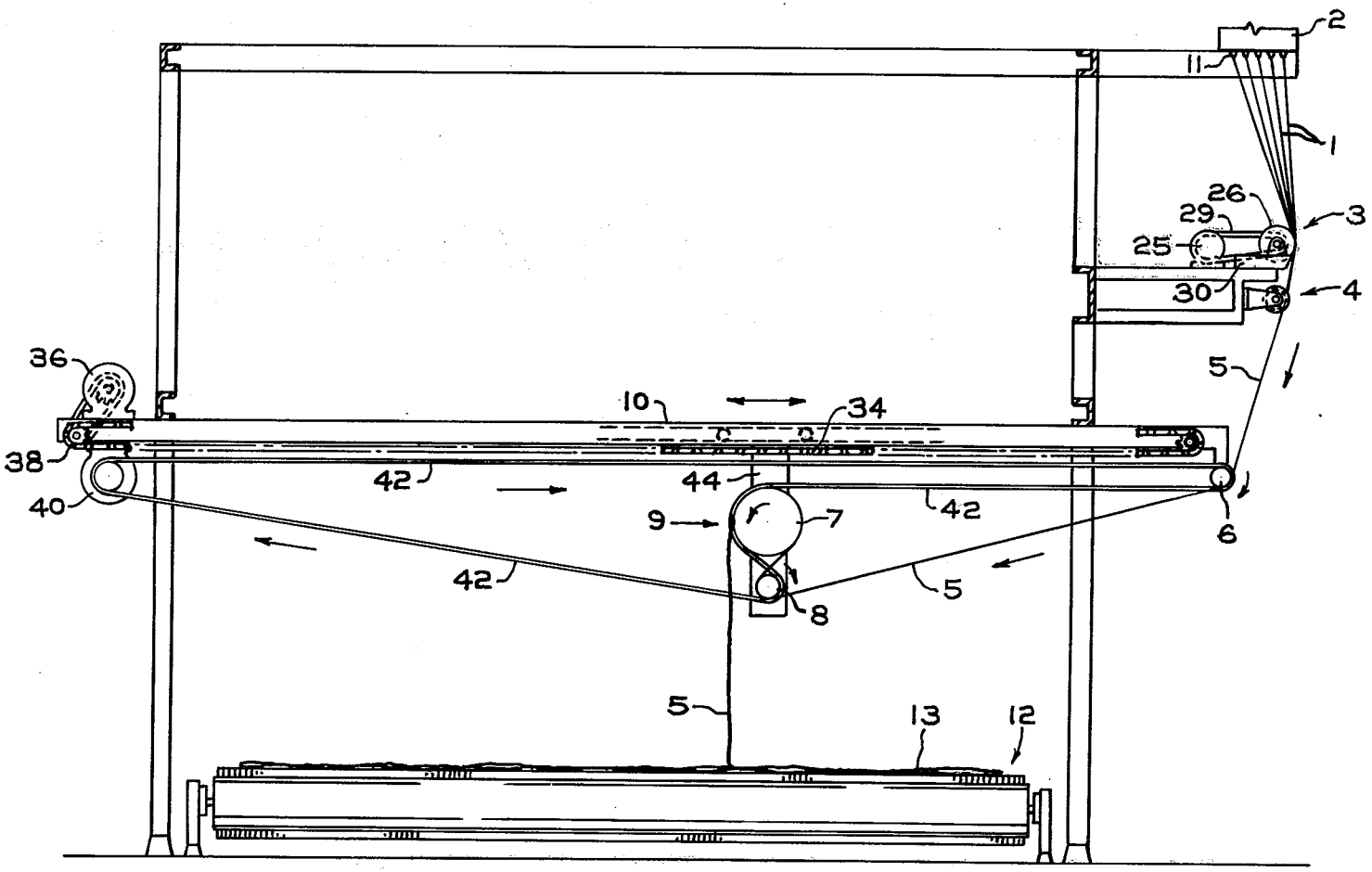
FIG. 1 is a schematic elevational end view of a single glass fiber forming bushing and the mat formation apparatus associated therewith, showing the fibers being attenuated, gathered into strands, and deposited onto the mat formation surface.

Turning to FIG. 1, a single forming position for producing continuous strand glass fiber mat is illustrated. It should be noted that a complete mat formation line will employ a plurality of these positions along the mat formation surface length.

Glass filaments 1 are attenuated through bushing tips 11 at the bottom of a heated bushing 2 which contains molten glass. The filaments 1 are passed across an application surface 26 where they are coated with a binder and/or size from a sump 30. The application surface 26 is shown as a roller connected by a belt 29 to a motor 25. It will be apparent to the skilled artisan that this applicator can be any conventional applicator such as a belt or pad applicator, a spray applicator or the like.

The filaments 1 are then passed across the face of a gathering shoe 4, which is a grooved wheel or cylinder formed of a material such as graphite. The filaments 1 are gathered by the gathering shoe 4 into one or more strands 5. If a plurality of strands are formed, the gathering shoe 4 may be replaced by a comb, as is known to those skilled in the art. The strands 5 pass across driven pulley 6, around a first wheel 8 of an attenuator 9, which is illustrated in this Figure as a wheel attenuator, and around the second wheel 7 of the attenuator 9. Attenuation is accomplished through cohesive forces between the wet coated strands 5 and the rotating wheels 8 and 7. The strands 5 are projected downwardly from the wheel 7 onto a mat formation surface 12, which is typically an endless belt or chain conveyor, where the continuous strands 5 are laid as a mat 13. The wheels 8 and 7 are attached by a bracket 44 to a carriage 34. The carriage 34 reciprocates across and above the face of the mat formation surface 12 such that the strand 5 is laid continuously across the mat formation surface 12. The carriage 34 is, in turn, attached to a chain 38 which is driven by a belt 37 connected to a reversing motor 36. The carriage 34 rides within a track 10 as it reciprocates across the strand formation surface 12. Typically, the speed of reciprocation for the attenuator 9 across the mat formation surface 12 is in the range of 75–150 feet per minute (25.9–45.7 meters per minute). Preferably, the attenuator 9 traverses in a perpendicular direction to the mat formation surface 12. However, the attenuator 9 may be oriented to lay down the mat at an oblique angle to the mat formation surface 12.

The wheels 6, 7 and 8 of the attenuator 9 are connected through an endless belt 42 to a constant speed motor 40. Alternative connection means, such as chains or the like, could also be employed. The belt 42 provides a constant speed of rotation to the stationary driven pulley 6, however, since the belt 42 travels at a constant velocity, the speed of the wheels 7 and 8 are varied in their speed of rotation by their speed of reciprocation, such that the net speed of attenuation of the wheels 7 and 8 is the sum or difference between the speed of the belt 42 and speed of reciprocation. Typical of the rates of strand lay down is from 1,000 to 5,000 feet per minute (304.8 to 1524 meters per minute). Thus, as the attenuator 9 reciprocates away from the bushing 2, its speed of rotation is the speed of the belt 42 minus the speed of reciprocation and as the attenuator 9 reciprocates towards the bushing 2, the speed of rotation of the wheels 7 and 8 is the speed of the belt 42 plus the speed of reciprocation of the attenuator 9. However at all times, the net speed of attenuation for the filaments 1 is equal to the speed of the belt 42. Therefore, the employment of a constant speed motor driving the wheels 7 and 8 results in a variation of wheel speed which compensates for the variation in reciprocation speed such that the net attenuation speed remains constant. This, of course, results in more consistent diameter filaments being formed throughout the reciprocation of the attenuator 9 and thus in a more uniform mat.

The slight difference in speed of strand lay down as the attenuator 9 is traversed towards the strand source and away from the strand source is not significant to mat uniformity. As the mat is laid, each traverse normally overlaps the previous traverse, thus resulting in a uniform mat along its length. This is further aided by the fact that typically six or more layers are laid from attenuation positions along the length of the mat formation surface 12.

As previously mentioned, the filaments are coated with a binder and/or size as they are attenuated. This binder and/or size is chosen such that the coated glass fibers to be manufactured into a mat will be compatable with the resin system which the mat is to reinforce. Thus, it is normal practice to tailor the binder and/or size to the resin system.

Often, the binder and/or size will include as a constituent thereof the resin which the mat is designed to reinforce, or a resin compatable with the resin to be reinforced. Thus, the binder and/or size often includes such resins as polyesters, polyurethanes, epoxies, polyamides, polyethylenes, polypropylenes, polyvinyl acetates and the like. When the resin to be reinforced is a thermoplastic resin, the binder and/or size normally includes a thermoplastic resin. When the resin to be reinforced is a thermoset resin, the binder and/or size normally includes a thermoset resin.

Two notable resins which are typically reinforced with mats are polypropylene and nylon. A preferred size system for use on glass fibers to be formed into a mat for polypropylene reinforcement is the size system found in U.S. Pat. No. 3,849,148, which is incorporated herein by reference. When the mat is to be used to reinforce a nylon resin, a preferred size system is that found in U.S. Pat. No. 3,814,592, which is incorporated herein by reference.

Figure 2:
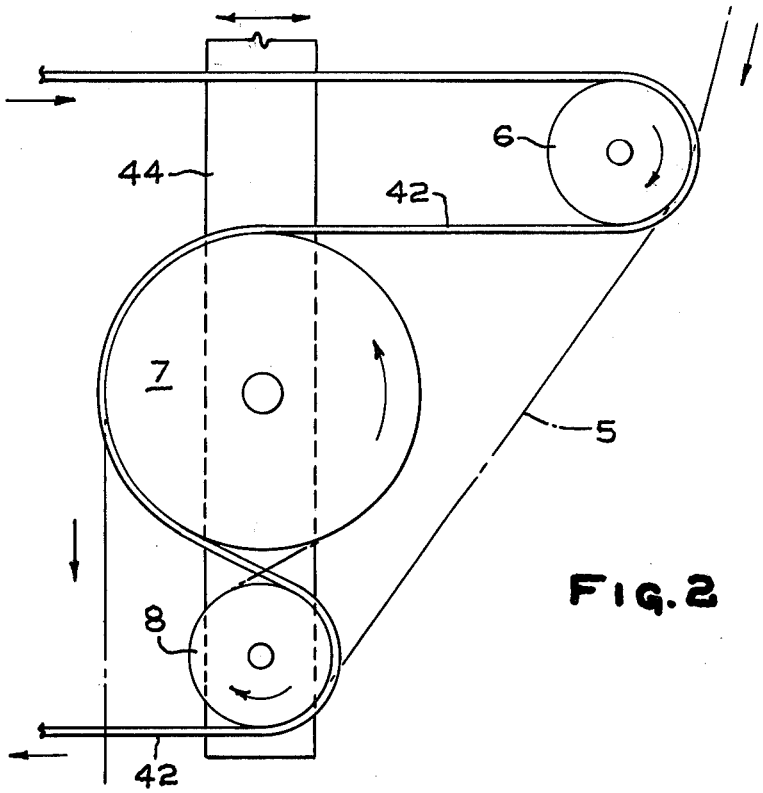
FIG. 2 is an expanded, front elevational view of a wheel attenuator according to the present invention as shown in FIG. 1.
Figure 3:
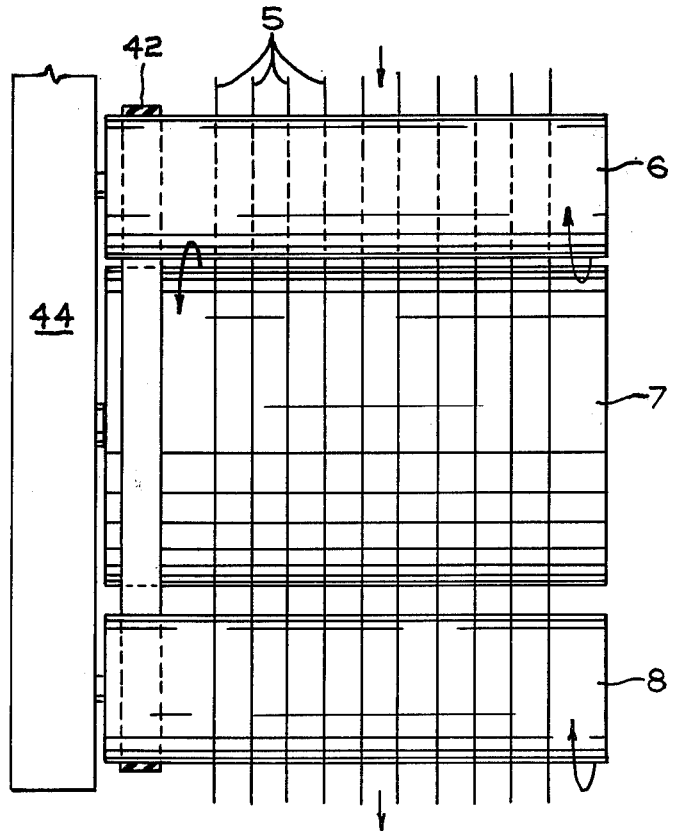
FIG. 3 is an expanded side elevational view of the attenuator of FIG. 2.

FIGS. 2 and 3 illustrate the orientation of the strands 5, the wheels 6, 7 and 8, and the belt 42. In FIG. 2, the attenuator 9 is in its closest position to the bushing 2. This figure illustrates the threading of the strands 5 across the driven pulley 6 and around the wheels 8 and 7 of the attenuator 9 and the wrapping of the belt 42 around the driven pulley 6 and the attenuator wheels 7 and 8. The belt 42 is additionally wrapped around the drive motor 40, as can be seen in FIG. 1.

In FIG. 3, the location of the belt 42 in relation to the strands 5 on the attenuator wheels 7 and 8 can be seen. The belt 42 is located at one edge of the rollers or wheels 7 and 8, and, in addition, the pulley 6, not shown. This is preferably the edge of the wheels closest to the carriage 44. The strands 5 pass across these wheels in approximately parallel relation along the balance of the faces of the wheels 7 and 8. Thus, the strands 5 do not cross the belt 42 nor are they attenuated between the belt 42 and the surfaces of the wheels 7 and 8. Attenuation is the result of cohesive forces between the wet binder and/or size coated glass strands and the smooth surfaces of the rotating wheels 7 and 8, which may be formed of a material such as aluminum, rubber, and the like, to maintian their weight as low as possible to thus allow maximization in the speed of traverse of the attenuator 9.

Figure 6:
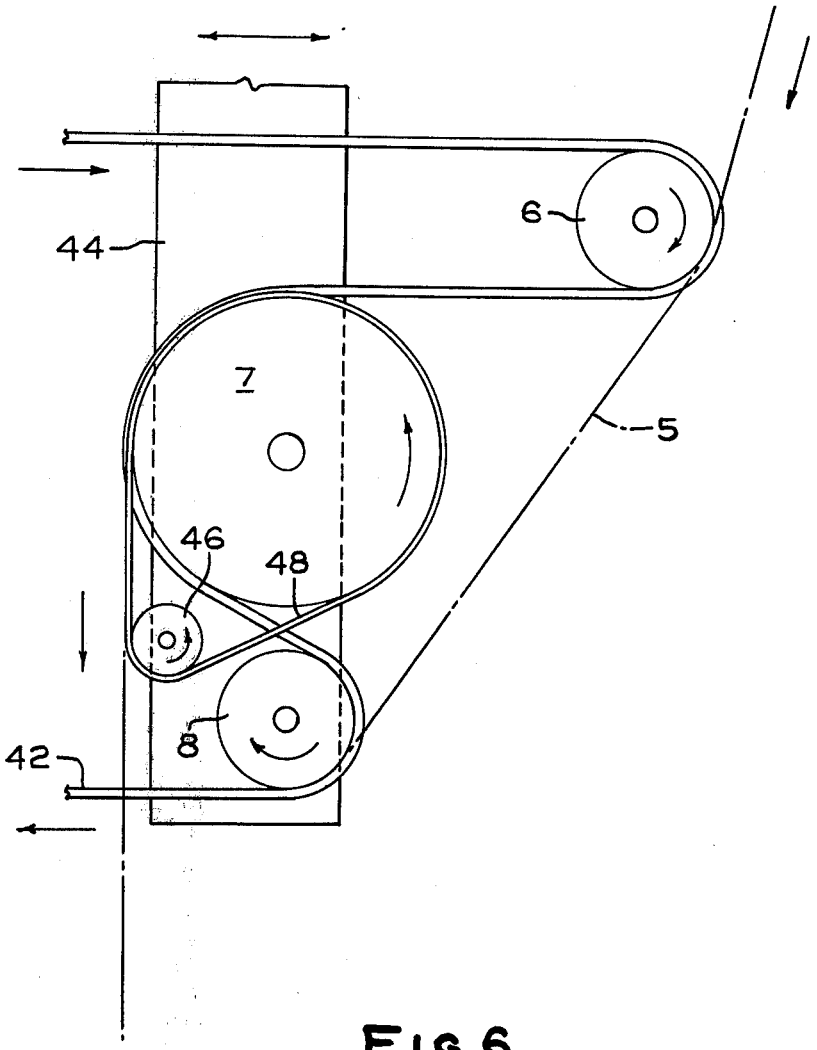
FIG. 6 is an expanded, front elevational view of a belt attenuator according to the present invention.

Some of the binders and/or sizes which may be employed adhere to wheel 7 with a high level of tenacity. In some cases, the adherence is so great that the strands 5 will not always leave wheel 7 and project downwardly onto mat formation surface 12, but will tend to wrap around wheel 7. In such cases, the belt attenuator illustrated in FIG. 6 may be employed.

In this embodiment an idler roller 46 is located on bracket 44. A belt 48 passes over idler roller 46 and driven wheel 7 and in front of drive belt or chain 42. Strands 5 pass around wheel 8 and over belt 48. The strands 5 do not pass between the belt 48 and the wheel 7, but rather pass over belt 48 and are attenuated or advanced by the cohesive forces between the belt 48 and the wet strands 5. The strands 5 are projected downwardly along belt 48 as the belt approaches idler roller 46. As the belt turns about roller 46, returning to wheel 7, the downward momentum of the strands 5 is greater than the adherence of the strands 5 to the belt 48. Thus, the strands 5 leave the belt 48 as it passes around roller 46 and the strands 5 are projected onto mat formation surface 12.

Since belt 48 is driven by wheel 7, its projection speed for the strands 5 will vary in the same manner as the rotational speed of wheel 7 varies, as in the previous embodiment, to give a constant net attenuation rate to the strands 5 as the attenuator traverses over the mat formation surface 12.

Figure 4:
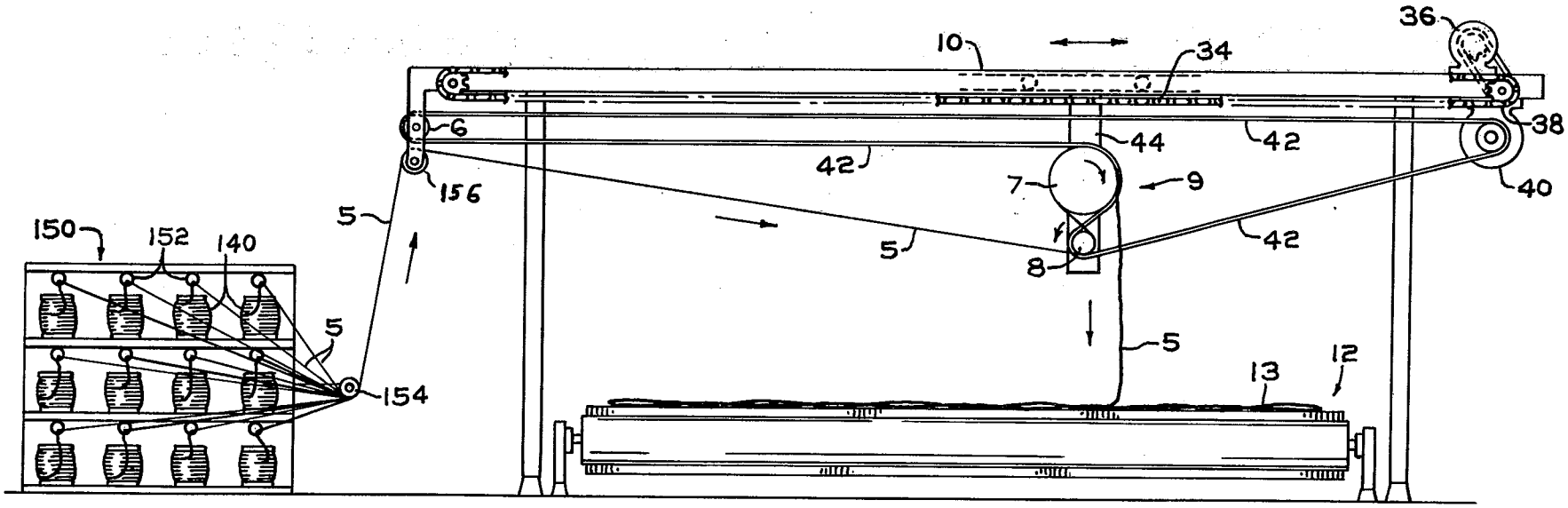
FIG. 4 is a schematic, longitudinal, end elevational view of a mat forming operation using packages of previously produced strand and employing a wheel attenuator of the present invention.

FIG. 4 illustrates the production of mat from packages of previously formed strand. Forming packages 140 of strand material are located on a creel 150. The forming packages may be of any natural or synthetic fiber, such as glass nylon, polyester, and the like. Strands 5 pass through strand guides 140 and through guide bar 154. Here, the strands 5 may be combined into one or more larger strands. Preferably, however, the strands 5 remain as separate strands and pass to driven roller 156 in a generally parallel path. Between creel 150 and attenuator 9 the strands are wet with water or another material to reduce the possibility of static build-up and to provide the cohesive force with the wheels 7 and 8 to advance the strands in any of numerous manners well known to those skilled in the art. For housekeeping reasons, it is preferred to wet the strands 5 between guide bar 150 and roller 156. Typically, the strands are wet to give 5–15 percent by weight moisture. A suitable antistatic material which may be added to the water is Triton X100, which is a nonionic isooctyl phenyl polyexothy ethanol surfactant. At this point, the strands 5 are advanced by attenuator 9 in the same manner previously mentioned.

Figure 5:
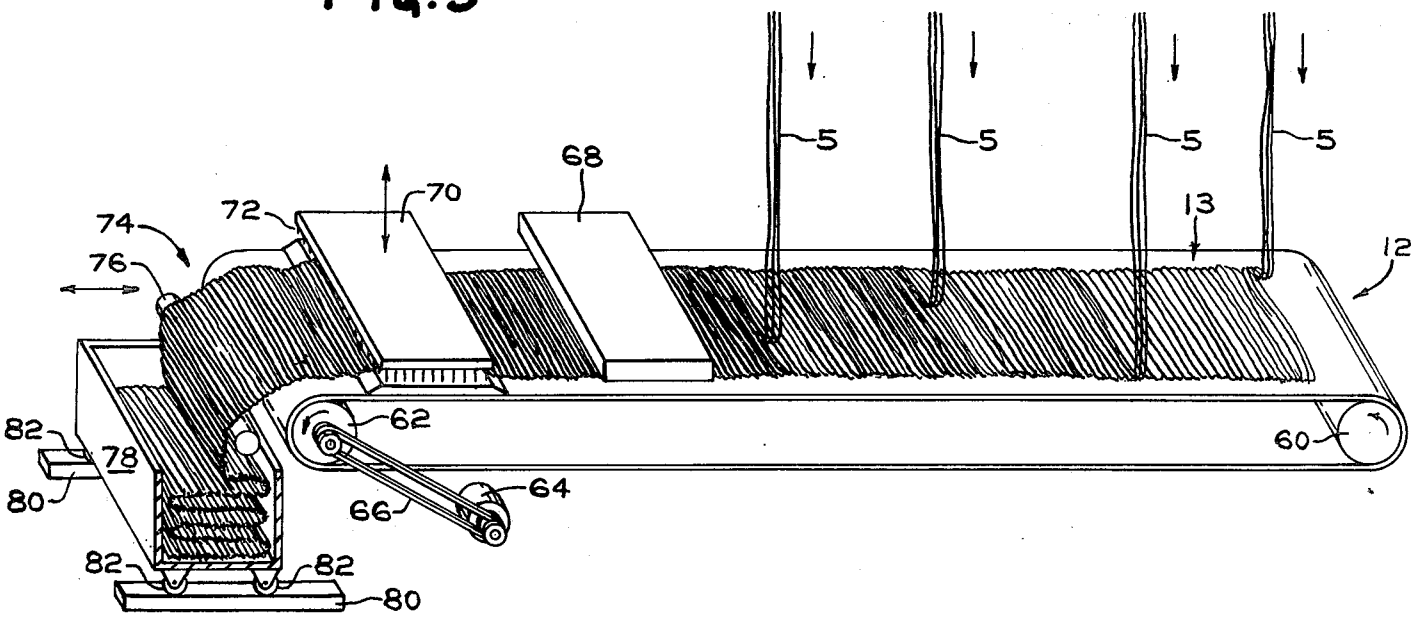
FIG. 5 is a diagrammatical perspective view illustrating a mat formation and needling operation.

FIG. 5 illustrates a mat formation and needling operation in which the attenuators of the present invention may be employed.

The strands 5 may be single strands of from 200 to 2000 filaments or more. Preferably, the filaments from each forming position are split into a plurality of strands 5, with each strand having from about 25–200 filaments. For example, for an 800 filament bushing, the filaments may be divided into 16 strands 5, with each strand 5 having 50 filaments. The strands 5 pass downwardly onto a mat formation surface 12 from the attenuator 9 as in FIGS. 1 and 4. The mat formation surface 12 is a continuous surface. It may be a belt surface, however, preferably it is a foraminous surface such as a chain conveyor. The mat formation surface 12 moves continuously over rollers 60 and 62. Roller 62 is driven by means of a belt or chain 66 connected to motor 64.

As the mat 13 moves along the surface of the belt 12, numerous operations may be performed on it. As previously mentioned, the strands 5, and thus the mat 13, are normally laid wet, typically having a percent moisture in the range of from about 5 to 15 percent by weight. Thus, during its travel along the mat formation surface 12, the mat 13 may pass under a dryer or suction box, schematically illustrated as 68. If a dryer is employed, it may be an infrared dryer, dielectric dryer or the like. As the mat 13 leaves the dryer or suction box 68, the percent moisture is reduced to about two percent by weight or less, and preferably less than one percent by weight. To accomplish this, the mat 13 passes continuously along the mat formation surface 12 and under the dryer or suction box 68 continuously, at rates typically from about 2–20 feet per minute (0.6 to 6.1 meters per minute).

After leaving the drying apparatus 68, the mat 13 may pass under a needler 70 having a plurality of needles 72. The needler 70 moves vertically above the mat 13 to push the needles 72 in and out of the mat 13 and produce a needled mat 74. Typically, the needled mat 74 may have a thickness of from about 0.125 to 0.375 inches (0.32 to 0.96 centimeters). After needling, the mat 74 typically has a weight of about one to six ounces per square foot (0.31 to 1.86 kilograms per square meter). Such needled mats are very useful for the reinforcement of resinous plastics, such as polypropylene and the like. As the mat 13 is needled, the continuous strands 5 are broken up by the needles 72 into a plurality of short and long fibers. The needled mat resulting from these short and long fibers gives strength in both the longitudinal and transverse directions. This results in a reinforced resin which also displays strength in both the longitudinal and transverse directions.

As the needled mat 74 exits the mat formation surface 12, it passes over guide bar 76 and into container 78. The needled mat 74 is folded upon itself as it is packaged in container 78 by reciprocating container 78 over tracks 80 by means of wheels 82 riding in tracks 80.

From the foregoing, it is obvious that the present invention provides a continuous mat formation system which produces a more uniform mat than previously obtainable, and at the same time allows increases in both the rate of mat production and the width of the mat which may be efficiently produced.

While the present invention has been described with reference to specific embodiments thereof, it is not intended to be so limited thereby, except as set forth in the accompanying claims.

I claim:

1. In a method of producing continuous glass strand mat comprising attenuating filaments through bushing tips in a bushing, applying a binder and/or size to the filaments, gathering filaments into a plurality of strands, traversing an attenuator for attenuating the filaments across a mat formation surface and projecting the strands onto the mat formation surface as the attenuator is traversed, the improvement comprising varying the speed of projection of the strands onto the mat formation surface in response to variations in speed of traverse of the attenuator to provide a constant speed of attenuation to the filaments and thereby produce consistent diameter filaments throughout their attenuation.

2. An apparatus for forming a continuous strand glass fiber mat comprising a bushing having a plurality of bushing tips through which filaments may be attenuated, an applicator for coating the filaments with a binder and/or size, a gathering means for combining the filaments into a plurality of unified strands, a mat collection surface and an attenuator for attenuating the filaments and projecting the strands onto the surface, said attenuator being variable in its rate of projection of strand onto the surface relative to its rate of traversing across the mat formation surface such that the speed of attenuation of the filaments from the bushing is maintained constant.

3. The apparatus of claim 2 wherein said attenuator comprises a plurality of wheels, said wheels being connected by a connecting means to a constant speed motor such that said wheels are varied in their rate of speed relative to their speed of traverse so that the total attenuation speed is constant.

4. The apparatus of claim 3 wherein said connecting means for said wheels to said motor is a belt.

5. The apparatus of claim 3 wherein said connecting means for said wheels is a chain.

6. The apparatus of claim 3 further comprising an idler roller and a belt, said belt being located around said idler roller and one of said wheels.

7. An attenuator for forming a continuous strand mat comprising a constant speed motor at one end of a traversing region, a stationary pulley at the other end of the traversing region, a plurality of wheels over which said strands pass and are attenuated along said traversing region, means for traversing said wheels and means for connecting said motor, pulley and wheels such that the speed of rotation of the wheels is varied with their rate of traversing such that the attenuation of the strands and their associated filaments is constant.

8. The apparatus of claim 7 wherein said means for connecting comprises a belt.

9. The apparatus of claim 7 wherein said means for connecting comprises a chain.

10. The apparatus of claim 7 further comprising an idler roller and a belt, said belt being located around said idler roller and one of said wheels.

11. In a method of producing continuous strand mat from strands of fiberous material comprising traversing an attenuator for advancing the strands across a mat formation surface and projecting the strands onto the mat formation surface as the attenuator is traversed, the improvement comprising varying the speed of projection of the strands onto the mat formation surface in response to variations in speed of traverse of the attenuator to provide a constant speed of attenuation to the filaments and thereby produce consistent diameter filaments throughout their attenuation.

12. A method of producing continuous strand mat comprising attenuating glass filaments from a bushing, separating the filaments into a plurality of strands, projecting the strands downwardly onto a surface for collection thereon as a continuous strand mat by reciprocating an attenuator across the collection surface in a direction generally transverse to the direction of movement of the collection surface and controlling the attenuation forces on the filaments such that the filaments are attenuated at a constant rate during the production of the mat.

13. The method of claim 12 wherein said controlling comprises varying the speed of passing the strands onto the collection surface at a rate equal to the changes in speed and direction of the attenuator as it passes over the mat formation surface to thereby provide a constant attenuation on the filaments.

14. An attenuator for forming a continuous strand mat comprising a constant speed motor at one end of a traversing region, a stationary pulley at the other end of the traversing region, a plurality of wheels over which said strands may pass, an idler roller, a belt surrounding said idler roller and one of said wheels such that said strands pass over said belt and are attenuated along said traversing region, means for traversing said wheels, idler roller and belt and means for connecting said motor, pulley and wheels such that the speed of rotation of the wheels is varied with their rate of traversing such that the attenuation of the strands and their associated filaments is constant.

15. The apparatus of claim 14 wherein said means for connecting comprises a belt.

16. The apparatus of claim 14 wherein said means for connecting comprises a chain.

* * * * *